US006250620B1

(12) United States Patent
Durfee, Jr.

(10) Patent No.: US 6,250,620 B1
(45) Date of Patent: Jun. 26, 2001

(54) MACHING VISE

(75) Inventor: David L. Durfee, Jr., Meadville, PA (US)

(73) Assignee: Parlec, Inc., Fairport, NY (US)

( * ) Notice: Subject to any disclaimer, the term of this patent is extended or adjusted under 35 U.S.C. 154(b) by 0 days.

(21) Appl. No.: 09/468,862

(22) Filed: Dec. 21, 1999

Related U.S. Application Data

(62) Division of application No. 08/988,700, filed on Dec. 11, 1997, now Pat. No. 6,017,026.

(51) Int. Cl.[7] ..... B25B 1/20

(52) U.S. Cl. ..... 269/43; 269/271; 269/136; 269/134

(58) Field of Search ..... 269/271, 43, 136, 269/134, 153, 154, 170, 215, 203, 137, 20, 138

(56) References Cited

U.S. PATENT DOCUMENTS 5,984,290 * 1/2000 Durfee, Jr. ..... 269/43
6,017,026 * 1/2000 Durfee, Jr. ..... 269/271

* cited by examiner

*Primary Examiner*—Joseph J. Hail, III
*Assistant Examiner*—Lee Wilson
(74) *Attorney, Agent, or Firm*—Shlesinger Fitzsimmons Shlesinger

(57) ABSTRACT

A machining vise which includes a main body having a recess for guiding movable vise jaws therein is disclosed. The vise also includes a stationary jaw removably mounted at a mid-point on the main body, a first movable slide and a second movable slide. The first and second slides are mounted in the recess for guiding the movable vise jaws, wherein the first jaw is removably mounted to the first movable slide and the second jaw is removably mounted to the second movable slide.

26 Claims, 6 Drawing Sheets

MACHING VISE

RELATED APPLICATION INFORMATION

This application is a divisional of U.S. patent application Ser. No. 08/988,700, filed Dec. 11, 1997, entitled "Machining Vise", and which is now U.S. Pat. No. 6,017,026.

BACKGROUND OF THE INVENTION

1. Field of the Invention

The invention relates to two station machining vises. More particularly, the invention relates to two station machining vises facilitating easy replacement of jaws, a highly stable body, guaranteed alignment of a central block, and an efficient drive system.

2. Description of the Prior Art

Two station machining vises are known in the art. These stations permit an individual to non-simultaneously mount two work pieces on a single vise during the machining process. These vises are generally provided with great versatility to enhance the performance of the vise by limiting the effort required to use and modify the vise.

For example, many vises are known which include replaceable jaws to permit modification of the vise jaws when the vise is to be used with different work pieces. Many of these vises employ a knuckle on the vise slide which receives the replaceable vise jaw. As shown in Applicant's prior U.S. Pat. No. 5,505,437, entitled "TWO STATION MACHINING VISE WITH REMOVABLE AND OFF-SETTABLE JAWS", which is incorporated herein by reference, these knuckles include contoured surface which engages a pin mounted in the underside of the vise jaw.

While structures such as these provide secure attachment of the vise jaw to the knuckle, the incorporation of the pin with the vise jaw is expensive. When jaws are manufactured to engage a knuckle such as that disclosed in the '437 patent, the vise jaw must be drilled to include a hole through which the pin may be placed. Once the pin is properly secured within the vise jaw, and the vise jaw is ready for use. This is an expensive and time consuming process that must be performed for each vise jaw to be used with a vise assembly employing the structure embodied in the '437 patent.

In addition, the main body of most two station machining vises is manufactured to include a recess into which the front and rear slides of the vise may be placed. Generally, the bodies are extruded with a central recess having only side walls, and the front and rear ends of the main body are left open. Unfortunately, these extruded main bodies do not stand up to the substantial stress placed on the vises, and ultimately the vises may bend out of alignment. When this occurs the vises is no longer useful, and the vise must be replaced. In addition, vises designed in this manner allow for vibrations while work pieces are being machined. The vibrations produce undesirable finishes on work pieces and excessive wear of the machining tools.

It is often desirable to provided a two station vise in which the rear vise jaw does not move until the front vise jaw fully engages the work piece. This is generally accomplished by providing the rear slide with a braking assembly that resists the movement of the rear vise jaw until the front vise jaw fully engages the work piece. Many of these two station vises are also provided with offset assemblies that work with the brake assembly to create a initial predetermined offset of the rear jaw when a work piece is being removed therefrom.

Unfortunately, the braking assemblies and the offset assemblies employed by current two station vises employ many components to achieve their desired results. As a result, they are often cumbersome and very difficult to manufacture. Further, the many components employed in these braking assemblies and offset assemblies make them difficult to use, adjust and repair.

A need, therefore, exists for a two station vise that overcomes the shortcoming of the prior two station vises. The present invention provides such a two station vise.

SUMMARY OF THE INVENTION

It is, therefore, an object of the present invention to provide a vise assembly including a main body for guiding at least one movable vise jaw. The vise assembly also includes a stationary jaw mounted on the main body and at least a first movable slide mounted in the main body for guiding the movable vise jaw. The first movable slide includes a first upwardly extending knuckle shaped to removably mount a first jaw to the first movable slide. The first knuckle includes a resiliently biased latch shaped and dimensioned to engage the first jaw and a pin integrally formed with the first knuckle to engage a camming surface formed within the recess of the first jaw, wherein the resiliently biased latch and the pin engage the first jaw to releasable coupled the first jaw on the first knuckle. The vise finally includes means for moving the first movable slide.

It is also an object of the present invention to provide a machining vise including a main body guiding a movable vise jaw mounted on a first movable slide. The machining vise also includes a stationary jaw removably mounted to the main body by at least one upwardly extending post removably mounted to the main body, wherein the upwardly extending post includes a tapered collar which engages a tapered surface of the main body to ensure proper positioning of the at least one upwardly extending post and the stationary jaw.

It is a further object of the present invention to provide a machining vise including a main body having a recess for guiding first and second movable vise jaws therein, wherein the main body is formed from a single block with a recess defined by a forward wall, a rear wall, side walls, and a bottom wall.

It is another object of the present invention to provide a machining vise including a main body having a recess for guiding movable vise jaws therein and a stationary jaw removably mounted at a mid-point on the main body. The machining vise also includes a first movable slide and a second movable slide mounted in the recess, wherein a first jaw is removably mounted to the first movable slide and a second jaw is removably mounted to the second movable slide. The machining vise further includes a brake assembly attached to the second movable slide to control the movement of the first movable slide and the second movable slide. Finally, the machining vise includes an offset assembly having an offset body integrally formed with the second movable slide to provide an initial offset movement of the second movable slide prior to the resistance of the brake assembly being overcome. The offset assembly includes an offset pin mounted for rotation within the offset body to establish a predetermined offset.

It is also an object of the present invention to provide a machining vise including a brake assembly attached to the second movable slide to control the movement of the first movable slide and the second movable slide, wherein the brake assembly includes a brake body coupled to the second movable slide and a resilient biased brake pad extending between the brake body and the main body for controlling movement of the second movable slide.

It is another object of the present invention to provide a machining vise including a drive shaft coupled to the first and second movable slides for moving the first and second slides in a controlled manner. The drive shaft includes a spline drive shaft mounted on the main body for rotation by the user and main screw shaft floatingly coupled to the spline drive shaft for rotation therewith, wherein a buffer is positioned between the spline drive shaft and the main body to permit some movement of the spline drive shaft as it is drawn with the movement of the main screw shaft.

It is a further object of the present invention to provide a machining vise including a single jaw conversion member adapted for selective attachment to the main body and the second movable slide such that the machining vise is converted to a single jaw machining vise permitting the machining of larger work pieces.

It is also an object of the present invention to provide a machining vise including a hydraulic drive for moving the first movable slide. The machining vise includes a first piston coupled to the first movable jaw and in fluid communication with the hydraulic drive, wherein hydraulic pressure supplied by the hydraulic drive causes the first movable slide to move the vise jaw between a clamped and an unclamped position.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
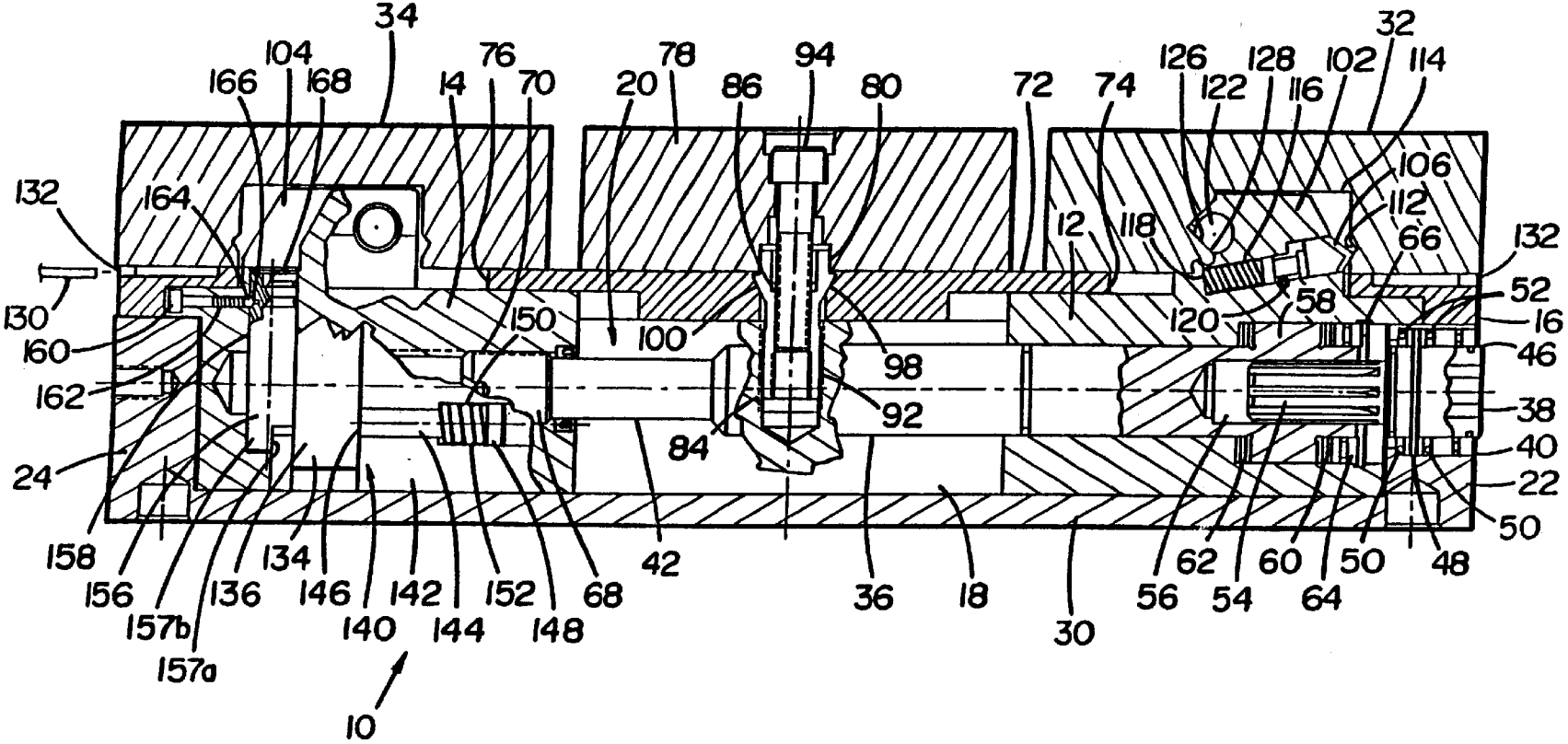
FIG. 1 is a cross sectional view of the present machining vise.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 through 4, a two station machining vise 10 is disclosed. The present machining vise 10 is designed to provide controlled movement of both a front slide 12 and a rear slide 14 such that the rear slide 14 moves to engage a work piece only after the front slide 12 has fully engaged a work piece.

The machining vise 10 includes a main body 16 provided with a recess 18 for housing the drive assembly 20 of the machining vise 10 and guiding the movable front and rear slides 12, 14 therein. The main body 16 is preferably manufactured from a single aluminum block with its core removed to create the recess 18. The recess 18 is substantially rectangular with straight upstanding walls. The shape of the recess 18 permits the drive assembly 20 to be placed within the main body 16 in a manner that will be discussed in greater detail below.

As such, the recess 18 is defined by a forward wall 22, a rear wall 24, a pair of side walls 26, 28 and a bottom wall 30. The unitary design of the main body 16 is resistant to deformation caused by the forces placed upon the machining vise 10. As such, the main body 16 will stand up to the great forces encountered during the machining process and retain its shape to optimize movement of the drive assembly 20 therein. Various openings and slots may be formed in the main body 16 to accommodate components of the present vise in a manner that will be discussed in greater detail below.

A front slide 12 and a rear slide 14 are mounted within the recess 18 for guiding the movable vise jaws 32, 34. The front slide 12 and the rear slide 14 are connected by a drive shaft 36 used to move the front and rear slides 12, 14 in a controlled manner. Specifically, the drive shaft 36 includes a spline drive shaft 38 mounted within a spline shaft opening 40 formed in the forward wall 22 of the main body 16. The spline drive shaft 38 is mounted within the spline shaft opening 40 for rotation (for example, by a hex handle) therein to drive the main screw shaft 42 of the drive shaft 36.

The spline drive shaft 38 is supported within the spline shaft opening 40 by a spline shaft cover plate 44 secured to the forward wall 22 of the main body 16. The spine shaft cover plate 44 holds the head 46 of the spline drive shaft 38 within spline shaft opening 40 of the forward wall 22. Rotational movement of the spline drive shaft 38 within the spline shaft opening 40 is controlled by mounting the flange 48 of the spline drive shaft 38 between spline drive shaft thrust bearings 50 and spline drive shaft buffer springs 52.

The spline drive shaft buffer springs 52 permit the spline drive shaft 38 to move along the axis of the spline drive shaft 38 within the spline shaft opening 40 when the main screw shaft 42 draws the spline drive shaft 38 toward the center of the main body 16. This may occur as the vise 10 is tightened and pressure causes the spline drive shaft 38 to virtually bond with the main screw shaft 42. When this occurs, the main screw shaft 42 will attempt to draw the spline drive shaft 38 toward the center of the main body 16. The spline drive shaft buffer spring 52 permits some lateral movement when this occurs to prevent the spline drive shaft 38 from binding within the spline shaft opening 40 (and allow for the transmission of full clamping pressure to the work piece).

The spline 54 of the spline drive shaft 38 is received within the coupling recess 56 of the main screw shaft 42. The spline 54 is floatingly received within the coupling recess 56 to permit relative movement when the spline drive shaft 38 drives the main screw shaft 42.

The main screw shaft 42 connects the front slide 12 and the rear slide 14 for movement in a manner that will be discussed in greater detail below. As such, the first end 58 of the main screw shaft 42 is supported within the front slide 12 for rotational movement therein. The first end 58 of the main screw shaft 42 is supported within a screw shaft recess 60 formed in the body of the front slide 12 and is retained in position by a main screw thrust bearing assembly 62, a main screw cover plate 64 and a main screw retainer ring 66. The second end 68 of the main screw shaft 42 engages a female screw shaft 70 of the rear slide 14. In this way, rotation of the main screw shaft 42 will either cause the front slide 12 to move or the rear slide 14 to move in a manner that will be discussed in greater detail below.

The recess 18 and the drive assembly 20 stored therein are protected from debris and various contaminates by a top plate 72 releasably secured to the main body 16. Specifically, the top plate 72 fits over the recess 18 and includes openings 74, 76 permitting appropriate attachment of the first and second vise jaws 32, 34 respectively to the front and rear slides 12, 14, as well as permitting the releasable attachment of the stationary center jaw 78 to the main body 16.

The top plate 72 is held in position by a series of bolts including first and second center jaw mounting studs 80, 82. The center jaw mounting studs 80, 82 are provided with both male threading 84 and female threading 86. In this way, they may be used to securely attach the top plate 72 to the main body 16, while also providing a female thread 86 for allowing the attachment of the center jaw 78 to the main body 16. Specifically, the center jaw mounting studs 80 are respectively passed through openings 88, 90 in the top plate 72 and screwed into mounting holes 92 formed in the main body 16 for receiving the center jaw mounting bolts 94 (only one shown).

Proper positioning of the center jaw mounting studs 80, 82 is ensured by providing a tapered collar 98 on each of the center jaw mounting studs 80, 82. The tapered collar 98 is designed to engage a tapered surface 100 on the opening 88 of the top plate 72. Engagement of the tapered collar 98 and the tapered surface 100 on the opening 88 of the top plate 72 ensures that the center jaw mounting studs 80, 82 extend upwardly in an ideal position for receipt of the center jaw 78.

Once the center jaw mounting studs 80, 82 are properly received in the main body 16 and the top plate 72, the stationary center jaw 78 is releasable coupled thereto. Center jaw mounting bolts 94 are passed through the center jaw 78 and into the respective female threaded portions 86 of the center jaw mounting studs 80, 82 to releasably couple the center jaw 78 on the main body 16.

As discussed above, the top plate 72 is provided with openings 74, 76 shaped and dimensioned to permit respective attachment of the front and rear vise jaws 32, 34 to the front and rear slides 12, 14. Each of the front and rear slides 12, 14 are, therefore, provided with upwardly extending knuckles 102, 104 shaped and dimensioned to releasable secure the front and rear vise jaws 32, 34 to the front and rear slides 12, 14.

Specifically, the front knuckle 102 extends from the upper surface of the front slide 12 and through the top plate 72. The front knuckle 102 includes first and second resiliently biased latches 106, 108 on its first side 110. The first and second resiliently biased latches 106, 108 are shaped and dimensioned to engage a jaw recess 112 formed along the inner surface 114 of the front jaw 32. The first and second latches 106, 108 are constructed from spring biased detent pins 116 held within respective recesses 118 formed along the first side 110 of the front knuckle 102. Each latch is also provided with a jaw detent pin retainer pin 120 that is provided to engage the jaw detent pin 116 of the latch to limit its movement within the recess 112.

The front knuckle 102 is also provided with a pin 122 along its second side 124. The pin 122 is removably formed with the front knuckle 102, and is shaped and dimensioned to engage a camming surface 126 formed along the inner surface 114 of the front jaw 32. The pin 122 is held in position by a retainer pin 123. The retainer pin 123 is pressed or screwed into the knuckle 102 and holds the pin 122 in position such that it is rotatable mounted to the front knuckle 102. This permits the pin 122 to rotate such that a flat surface 128 on the pin 122 aligns with the camming surface 126 on the inner surface 114 of the front jaw 32. In use, the resiliently biased latches 106, 108 and the pin 122 engage the front jaw 32 to releasable couple the front jaw 32 on the front knuckle 102.

As with the front knuckle 102, the rear knuckle 104 extends from the upper surface of the rear slide 14 and through the top plate 72. The details of the rear knuckle 104 are not shown in the Figures, however, it should be understood that the front and rear knuckles 102, 104, as well as the under structure of the first and second jaws 32, 34, are substantially identical. As such, the rear knuckle 104 includes first and second resiliently biased latches on its first side. The first and second resiliently biased latches are shaped and dimensioned to engage a recess formed along the inner surface of the rear jaw 34. The first and second latches are respectively constructed from spring biased detent pins held within respective recesses formed along the first side of the second knuckle 104. Each latch is also provided with a jaw detent pin retainer pin that is provided to engage the jaw detent pin of the latch to limit its movement within the recess.

The rear knuckle 104 is also provided with a pin along its second side. The pin is integrally formed with the rear knuckle 104, and is shaped and dimensioned to engage a camming surface formed along the inner surface of the rear jaw. The pin is rotatable mounted to the rear knuckle 104 to permit rotation therein such that a flat surface on the pin will align with the camming surface on the inner surface of the rear jaw. In use, the resiliently biased latch and the pin engage the rear jaw 34 to releasable coupled the rear jaw 34 on the rear knuckle 104.

Since the pins 122 of the first and second knuckles 102, 104 are subjected to substantial wear as a result of the attachment and removal of different vise jaws, the pins 122 may be manufactured from a material which is harder than the other materials from which the front and rear slides 12, 14 are manufactured. In this way, wear of the knuckles 102, 104 will be reduced, providing a longer life for the present machining vice 10. In addition, the pin 122 may be readily replaced by removing the retainer pin 123 when the pin 122 is worn or damaged. In this way the present invention permits ready replacement of the pin 122, thereby avoiding expensive replacement of the entire knuckle.

The pins 122 are also shaped and positioned to engage a camming surface 126 on the vise jaws 32, 34 such that when the jaws tighten down on a work piece the pressure forces the jaws 32, 34 downwardly against top plate 72 and into secure engagement with the knuckles 102, 104. The secure attachment of the vise jaws 32, 34 to the knuckles 102, 104 is thereby ensured. The front and rear jaws 32, 34 are removed from the respective front and rear slides 12, 14 by positioning a thin pry bar 130 within a jaw pry slot 132 and forcing the jaws 32, 34 from the knuckles 102, 104 when upward pressure is applied by the pry bar.

Figure 3:
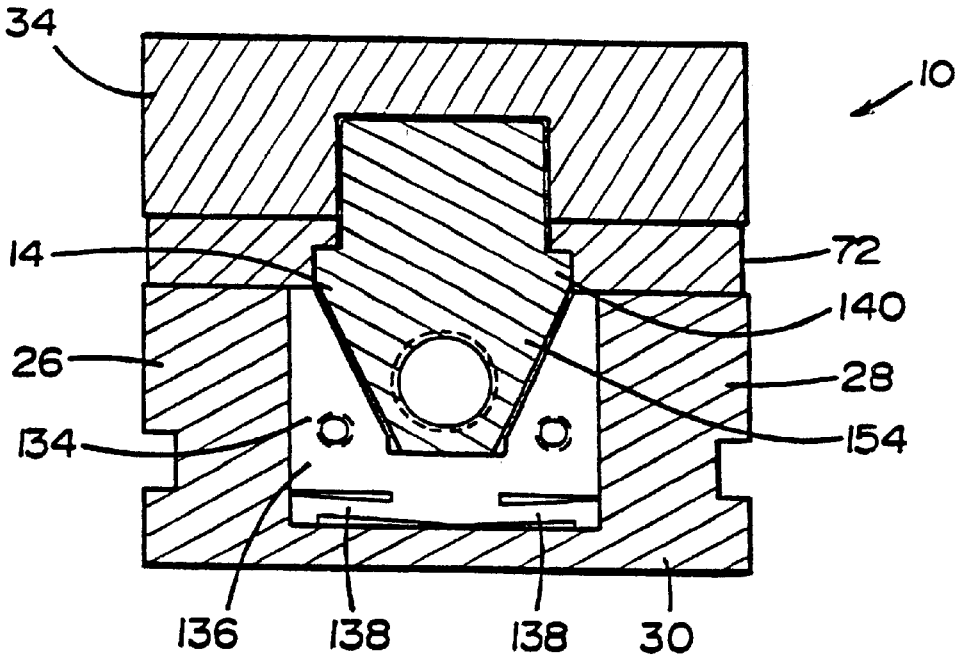
FIG. 3 is cross sectional view along the line III-III in FIG. 1.
Figure 4:
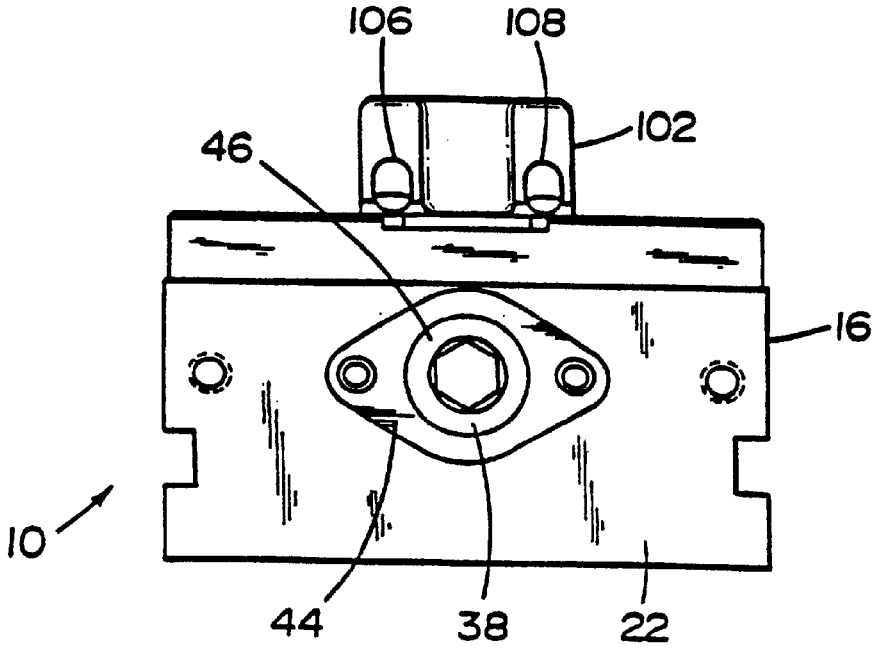
FIG. 4 is an end view of the present machining vise along the line IV—IV of FIG. 1.

With reference to FIGS. 1 and 3, the controlled movement of the front slide 12 relative to the rear slide 14 is created by the provision of a braking assembly 134 on the rear slide 14. The braking assembly 134 is designed to prevent movement of the rear slide 14 until such a time that the front slide 12, and the front jaw 32, engage a work piece when the vise 10 is tightened. When a work piece is so engaged, the force applied to the rear slide 14 is increased as the main screw shaft 42 is turned, causing movement of the rear slide 14 when the resistance of the brake assembly 134 is overcome.

The brake assembly 134 includes a brake body 136 formed with the rear slide 14. Resilient braking pads 138 are integrally formed with the brake body 136 of the brake assembly 134. The resilient braking pads 138 are positioned to extend between the brake body 136 and the bottom wall 30 of the recess 18 of the main body 16 to create resistance to the movement of the rear slide 14. The resilient braking pads 138 are similar to leaf springs and provide constant pressure to the bottom wall 30 of the recess 18. The constant pressure ensures reliable and controlled movement of the rear slide 14.

The resistance is ensured when the top plate 72 is positioned over the rear slide 14, thereby forcing the resilient braking pads 138 into contact with the bottom wall 30 of the recess of the main body 16. The brake assembly 134 is preferably constructed from brass to improve the wear resistance properties of the brake assembly 134 and improve the resistance provided by the braking assembly 134 as it is moved within the recess of the main body 16.

The rear slide 14 is also provided with an offset assembly 140. The offset assembly 140 permits a user to move the second jaw 34 a small distance from the work piece before the resistance of the braking assembly 134 is encountered. As discussed above, once the resistance of the braking assembly 134 is encountered, further movement of the rear slide 14 is prevented until such a time that the front slide 12 is fully withdrawn from the work piece it is holding. The offset assembly 140 provides two or more settings to control the offset movement of the rear slide 14 relative to a work piece.

Figure 2:
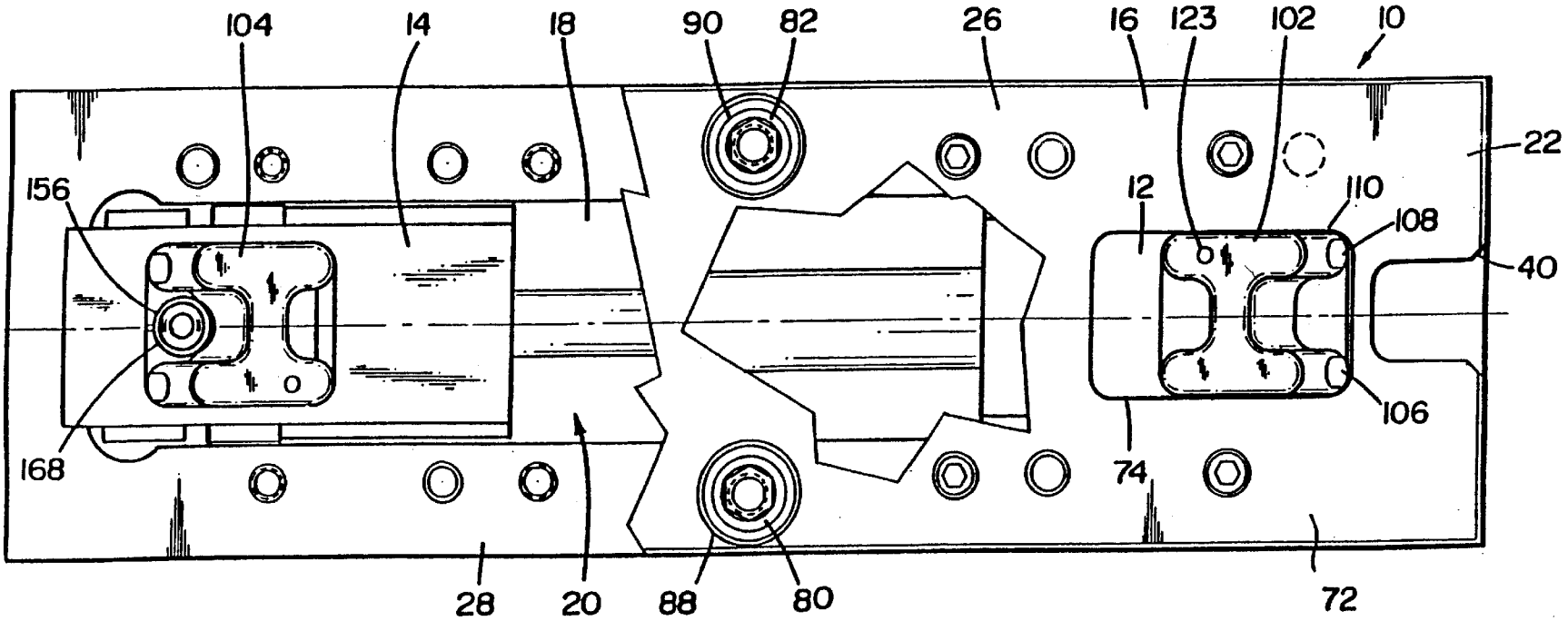
FIG. 2 is a top view of the present machining vise with a partial cut away of the top plate.

With reference to FIGS. 1, 2 and 3, the offset assembly 140 includes an offset body 142 integrally formed with the rear slide 14. The offset body 142 is integrally attached to the rear knuckle 104 and the rear vise jaw 34 to control the movement of the rear vise jaw 34 in relation to a work piece. The offset body 142 is formed with the rear slide 14 such that the offset body 142 will move relative to the brake assembly 134 when sufficient pressure is applied to the rear slide 14. Specifically, an offset friction brake shoulder bolt 144 couples the rear slide 14 and the offset assembly 140 to the brake assembly 134 for relative movement between the components. The relative movement is controlled by the offset friction brake shoulder bolt 144 which that has a first end 146 rigidly coupled to the brake assembly 134 and a second end 148 contained within a slot 150 formed in the rear slide 14. Movement of the offset assembly 140 relative to the brake assembly 134 is controlled by the inclusion of an offset friction brake return spring 152 within the slot 150. The spring 152 functions to control movement of the rear slide 14 and the offset assembly 140 relative to the brake assembly 134 in a manner that will be discussed in greater detail below. While only one offset friction brake shoulder bolt 144, offset friction brake return spring 152, and slot 150 within the rear slide 14 are shown in FIG. 1, the preferred embodiment of present machining vise 10 includes an additional set of components positioned on the opposite side of the braking assembly 134.

With reference to FIGS. 1 and 3, the brake assembly 134 is substantially U-shaped and wraps about a central portion 154 of the rear slide 14. As such, the rear slide 14 is free to move relative the brake assembly 134 as limited by the offset friction brake shoulder bolt 144, offset friction brake return spring 152, and slot 150 within the rear slide 14 discussed above.

The offset is controlled by an offset option dial 156 housed within a recess 158 formed in the offset body 142. The offset option dial 156 is retained with the recess 158 by an offset dial detent screw 160, offset dial detent spring 162 and offset dial detent ball 164, which engage a groove 166 in the upper end 168 of the offset option dial 156. The offset option dial 156 is retained in such a way that it is free to rotate when pressure is applied to adjust the offset as desired by the user.

Once the offset is set by the user, rotation of the main screw shaft 42 will cause the offset body 142 to move the offset distance before the resistance of the brake assembly 134 is overcome. In this way, the rear vise jaw 34 may travel the offset distance before the resistance provided by the brake assembly 134 must be overcome to further move the rear slide 14.

Use of the present machining vise 10 will now be described. Once the work pieces are properly positioned and ready for attachment to the machining vice 10, the spline drive shaft 38 is rotated to drive the main screw shaft 42. Rotation of the main screw shaft 42 initially causes the front slide 12 to move into engagement with the work piece. Once the work piece is engaged, the rear slide 14 commences movement when the resistance of the braking assembly 134 is overcome. In doing so, however, the offset body 142 is initially moved the offset distance before the resistance provided by the brake assembly 134 is overcome. This moves the heads of the offset friction brake shoulder bolts 144 to compress the offset friction brake return springs 152. Once the offset body 142 is moved the offset distance, the brake assembly 134 resistance is overcome and the entire rear slide 14 begins to move.

The amount of separation permitted is controlled by the rotation of the offset option dial 156. Rotation of the dial 156 aligns the desired one of the faces 156*a*, 156*b* of the offset option dial 156 with the brake body 136. Thus, as the rear slide 14 and offset body 142 move from the brake assembly 134 prior to overcoming the resistance of the brake assembly 134, the offset body 142 moves forward until it contacts the brake body 136. When the offset body 142 has contacted the brake body 136, and the main screw shaft 42 continues to apply force, the resistance of the brake assembly 134 is overcome and the rear slide 14 is caused to move in the closing direction.

When action is taken to open the jaws 32, 34, the rear slide 14, as a result of the offset friction brake return springs 152 is caused to open by the offset amount prior to the resistance of the brake assembly 134 being overcome. Thus, the second work piece may be removed. Further rotation of the handle (not shown) causes the front slide 12 to move as the rear slide 14 is held in position by the brake assembly 134. Once the front slide 12 is fully moved to its opened position, the main screw shaft 42 applies sufficient pressure to the rear slide 14 to overcome the resistance of the brake assembly 134 and move the rear slide 14 to its fully open position.

Figure 5:
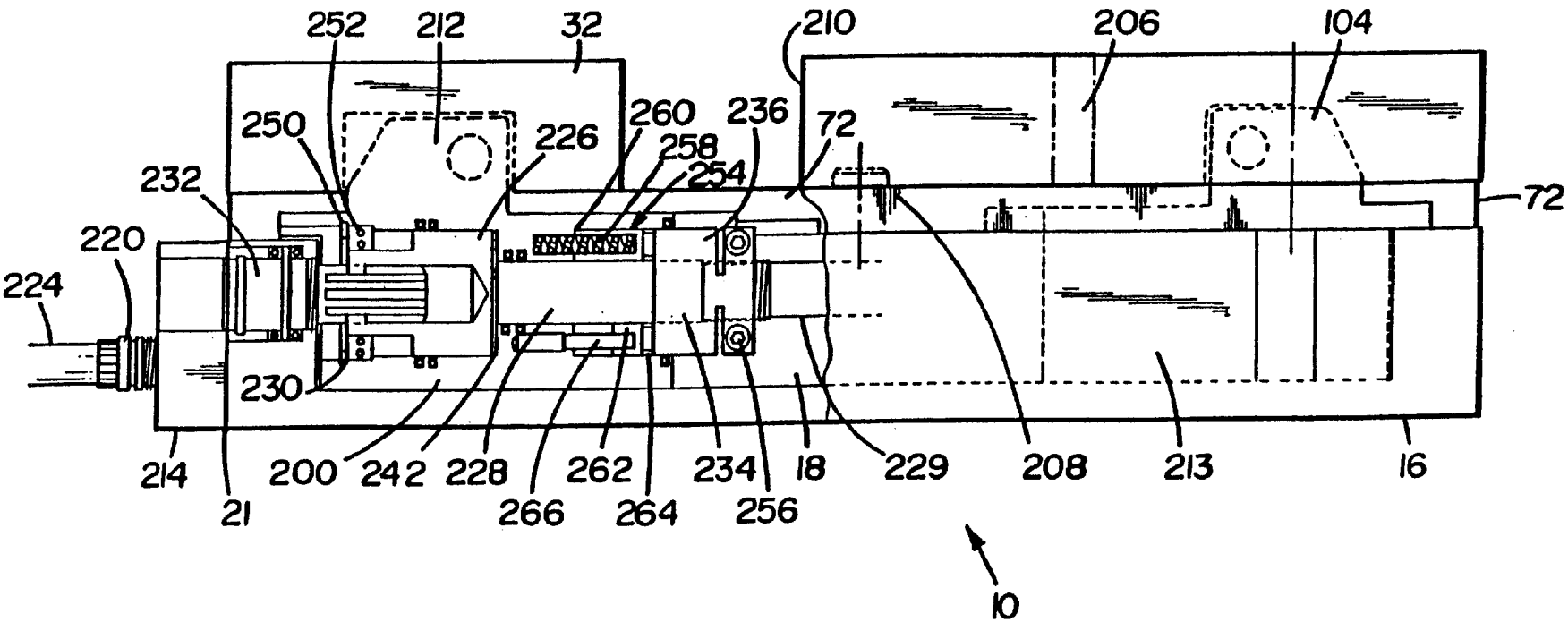
FIG. 5 is cross sectional view of an alternate embodiment of the machining vise employing a hydraulic drive assembly along the line V—V of FIG. 7.
Figure 6:
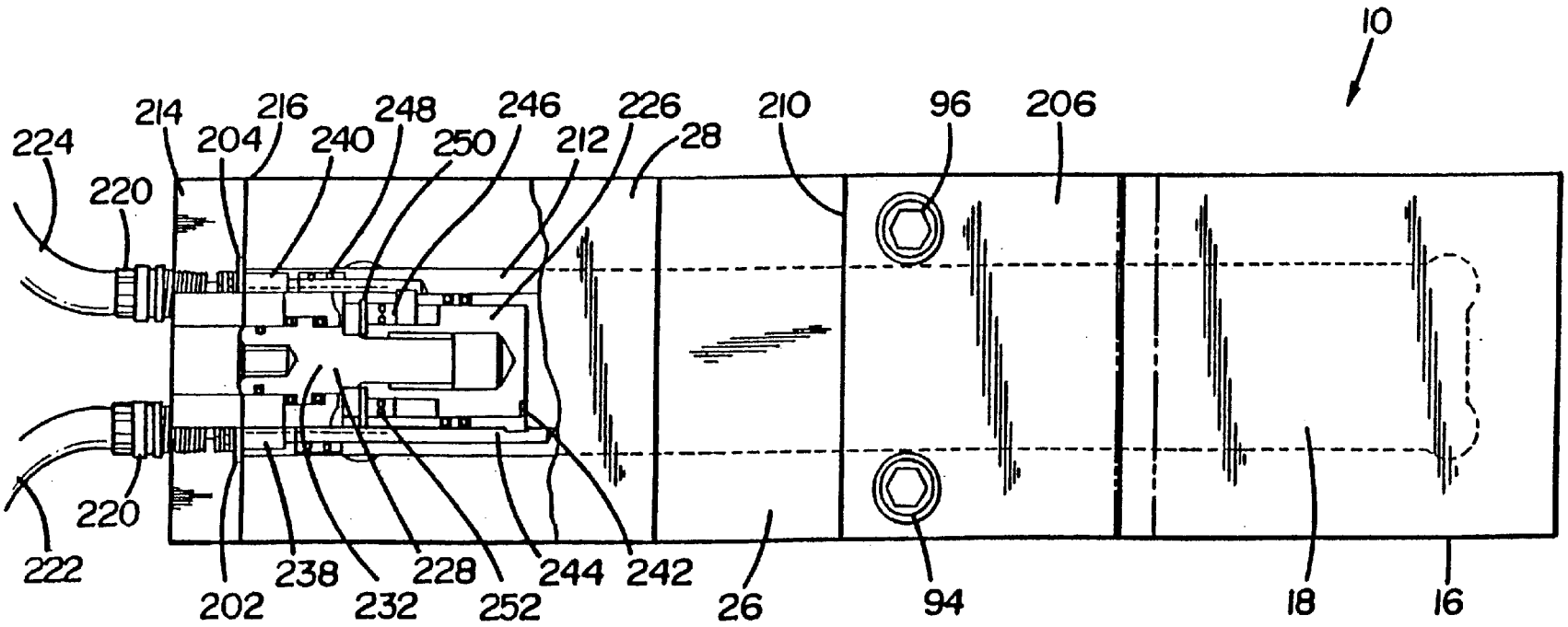
FIG. 6 is cross sectional view of the alternate embodiment of the machining vise employing a hydraulic drive assembly along the line VI—VI of FIG. 7.
Figure 7:
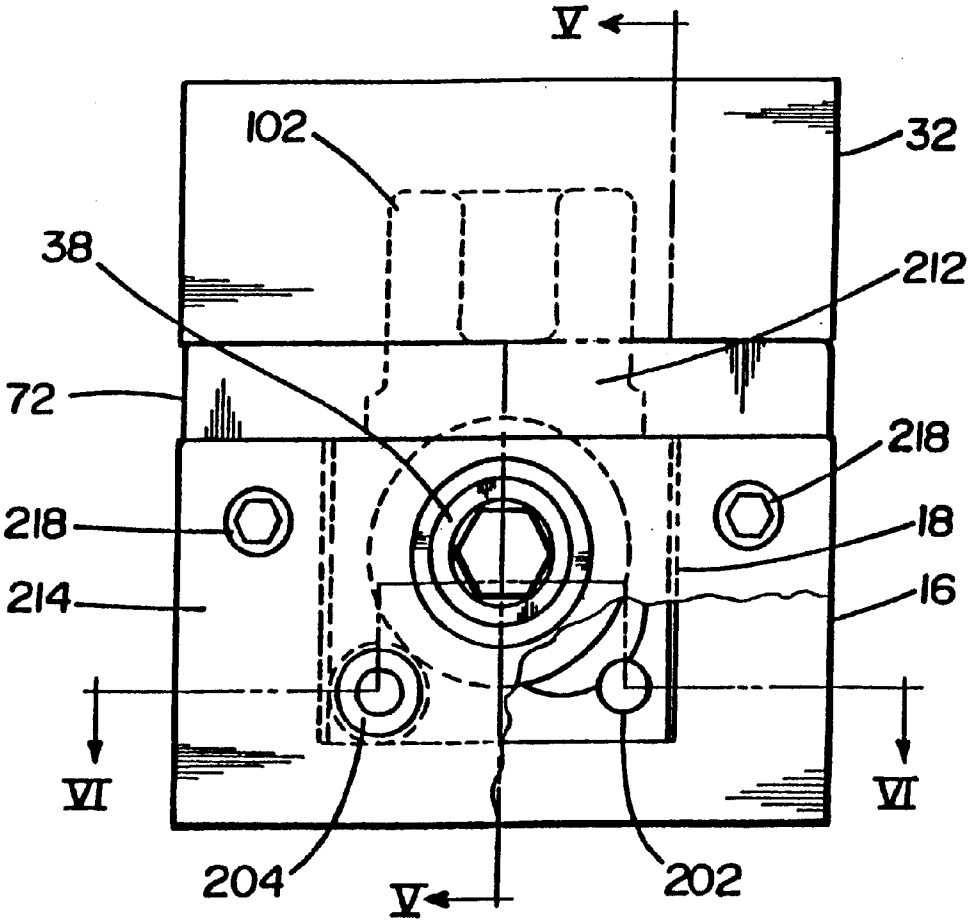
FIG. 7 is an end view of the alternate embodiment of the machining vise.

An alternate embodiment of the present machining vise 10 invention employing a hydraulic drive assembly 200 is disclosed in FIGS. 5 to 7. The alternate hydraulic drive assembly 200 may be readily used with the main body 16 described above. In fact, the hydraulic drive assembly 200 may be placed in use by removing the drive assembly 20 described above from the main body 16 and inserting the hydraulic drive assembly 200 within the recess 18 of the main body 16. Accordingly, the main body 16 is provided with first and second hydraulic line openings 202, 204 for purposes that will be fully appreciated after reading the following disclosure.

The embodiment disclosed in FIGS. 5 and 6 shows the machining vise 10 set up for use as a single station vise. The machining vise 10 may be used as a single station vise in either the first embodiment disclosed in FIGS. 1 to 4 or the second embodiment disclosed in FIGS. 5 to 7. The machining vise 10 is converted to a single station machining vise by placing a single station vise jaw 206 over the rear knuckle 104 and the central portion 208 of the main body 16 such that the forward end 210 of the single station vise jaw 206 extends to face the front jaw 32.

The center jaw mounting studs 80, 82 and center jaw bolts 94, 96 releasably couple the single station vise jaw 206 to the main body 16 in the same manner as discussed above with regard to releasably mounting the center jaw 78 to the main body 16. When the single station vise jaw 206 is mounted to the main body 16, the machining vise 10 functions as a single station vise enabling the vise to be used for larger pieces than might be permitted when the machining vise 10 is employed in its two station configuration.

With regard to the hydraulic drive assembly 200, it should be understood that the disclosed system employs substantially the same screw and brake structure as the first embodiment, but employs a hydraulic drive assembly 200 to securely tighten the jaws onto a work piece. As such, the screw and brake structures will not be discussed below as they were disclosed in sufficient detail above.

The hydraulic drive assembly 200 includes a hydraulic manifold 214 coupled to the front end 216 of the main body 16. The hydraulic manifold 214 is coupled to the front end 216 of the main body 16 by a pair of hydraulic manifold mounting screws 218. Hydraulic line fittings 220 couple first and second hydraulic lines 222, 224 to the hydraulic manifold 214 to supply hydraulic power to the drive assembly 200. As will be discussed in greater detail below, the first hydraulic line 222 supplies hydraulic pressure to clamp the front jaw 32 onto a work piece, while the second hydraulic line 224 supplies hydraulic pressure to unclamp the front jaw 32 from a work piece.

The hydraulic drive assembly 200 also includes a hydraulic front slide 212 coupled to the first and second hydraulic lines 222, 224 such that the hydraulic pressure controls the movement of the hydraulic front slide 212. Controlled movement of the hydraulic front slide 212 and rear slide 213 is provided by a front piston 226 incorporated with the drive shaft 228 of the hydraulic drive assembly 200. The front piston 226 is slidably received within the front slide 212 to permit relative movement between the front slide 212 and the front piston 226 in a manner that will be discussed in greater detail below. The drive shaft 228 also includes a screw drive shaft 229 similar to that discussed above with regard to the first embodiment. In fact, the first end 230 of front piston 226 is coupled to the spline 232 of the drive shaft 228 and the second end 234 of the piston 226 is coupled to the drive shaft 228 by a retainer bracket 236. This arrangement allows rotational movement to pass through the front piston 226 and drive the front and rear slides. In this way, the piston 226 is an integral part of the drive shaft 228.

Hydraulic pressure supplied through the first and second hydraulic feed tubes 238, 240, which are respectively in communication with the first and second feed lines 222, 224, drive the front piston 226 and the front slide 212 to cause linear movement of the front slide 212 and the rear slide 213. Specifically, the first feed tube 238 supplies hydraulic pressure to the rear 242 of the front piston 226 such that the front slide 212 is moved to clamp onto a work piece. Hydraulic pressure is supplied to the rear 242 of the front piston 226 via a rear channel 244 in fluid communication with the rear 242 of the front piston 226. As such, the pressure build up on the rear channel 244 causes the front slide 212 to move and clamp a work piece between vise jaws. Once the front slide 212 moves to fully clamp a work piece, continual hydraulic pressure causes the piston 226 and drive shaft 228 to move and draw the second slide 213 into engagement with a second work piece. The movement of the second slide 213 subsequent to clamping of the first slide 212 is substantially similar to the movement encountered in the embodiment discussed above with regard to FIGS. 1–4.

Similarly, the second feed tube 240 supplies hydraulic pressure to the front 246 of the front piston 226 such that the front slide 212 is moved to unclamp a work piece. Hydraulic pressure is supplied to the front 246 of the front piston 226 via a front channel 248 in fluid communication with the front 246 of the front piston 226. As such, the pressure build up in the front channel 248 causes the front slide 212 to move and unclamp a work piece previously held between vise jaws. A retainer ring 250 and a cylinder end cap 252 are provided in the piston assembly to maintain a closed environment for the hydraulic pressure being supplied to the front slide 212. As with the clamping of work pieces, the hydraulic pressure supplied to the front 246 of the front piston 226 causes the second slide 213 to unclamp in much the same manner as discussed above with regard to FIGS. 1–4.

The two line hydraulic system described above is a double acting hydraulic system. While a double acting system functions in a highly effective manner, many individuals have a personal preference for single acting hydraulic systems. As such, the present hydraulic drive system is designed to also function as a single acting hydraulic system.

Specifically, the front slide 212 is provided with a spring powered return assembly 254 which causes the front slide 212 to move to an unclamped position when hydraulic pressure is not supplied through the first hydraulic line 222. The return assembly 254 includes a retainer bracket 236. The retainer bracket 236 is coupled between the front slide 212 and the portion of the drive shaft extending to the second slide. The retainer bracket 236 is fixedly coupled to drive shaft 228 by a plurality of retainer bracket screws 256 such that a series of springs 258 coupled between the retainer bracket 236 and the first slide 212 may push against the retainer bracket 236 to move the front slide 212 toward the front end 216 of the main body 16 and to an unclamped position. The retainer bracket 236 is also fixedly coupled to the piston 226, permitting the transmission of rotational force along the drive shaft 228. The retainer bracket 226 is coupled to the front slide 212 to permit longitudinal motion. By allowing longitudinal motion between the retainer bracket 236 and the front slide 212, the front slide 212 is permitted to move toward the front end 216 of the main body 16 when the spring pressure of the return assembly 254 dictates.

The application of spring pressure is achieved by a plurality of springs 258 positioned within, and about, the front slide 212. The springs 258 is held within channels 260 formed in the front slide 212 and a thrust plate 262 positioned adjacent the retainer bracket 236. A thrust bearing 264 is placed between the thrust plate 262 to allow free rotational movement between the thrust plate 262 and the retainer bracket 236 when the drive shaft 228, and the retainer bracket 236, are rotated. In addition, at least one alignment pin 266 is positioned between the thrust plate 262 and the front slide 212 to maintain proper alignment.

When a single acting hydraulic system is employed, the front slide 212 and the rear slide 213 are actuated to clamp onto work pieces when hydraulic pressure is applied to the rear 242 of the front piston 226. When the hydraulic pressure is released, the return assembly 254 applies pressure to the front slide 212 causing it to move toward the front end 216 of the main body 16. The movement causes the front jaw 32 to unclamp from the work piece. Similarly, the second slide is moved to an unclamped position by the offset assembly 140 discussed above with regard to FIGS. 1–4.

Whether the hydraulic drive assembly 200 is used as a single acting or a double acting hydraulic system, clamping of a work piece is accomplished in the following manner. The drive assembly 200 is first rotated as discussed above until the jaws 32, 34 clamp onto the work piece. When both the front and rear slides are used, the drive assembly 200 is rotated until the front and rear jaws 32, 34 clamp onto respective work pieces. Once the work pieces are engaged, the drive assembly 200 is rotated to slightly unclamp the work pieces. At this time, the hydraulics of the drive assembly are used to tighten the vise jaws on the work pieces.

First, hydraulic pressure is applied to the rear 242 of the front piston 226 via the first hydraulic line 222 (if the second jaw is to be moved, hydraulic pressure would be applied to the front of the rear piston), causing the front slide 212 to move and tighten the work piece in place. Once the front slide 212 fully clamps the work piece, hydraulic pressure continues to be applied to the rear 242 of the front piston 226. This causes the piston 226 and drive shaft 228 to apply pressure to the second slide overcoming the brake assembly 134 and moving the second slide 213.

When it is desired to unclamp the work piece in accordance with a double acting hydraulic system, hydraulic pressure is applied to the front 246 of the front piston 226 via the second hydraulic line 224 (if the second jaw is to be moved, hydraulic pressure is applied to the rear of the rear piston), causing the front slide 212 and rear slide 213 to move away from the work piece and unclamp the work piece. When it is desired to unclamp the work piece in accordance with a single acting hydraulic system, the hydraulic pressure in the first hydraulic line 222 is released, allowing the return assembly to move the front slide 212 away from the work piece and unclamp the work piece. Similarly, the offset assembly 140 moves the second slide 213 away from the work piece to unclamp the work piece.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A machining vise, comprising:

a main body having a recess for guiding first and second movable vise jaws therein, the main body being formed from a single block with a recess defined by a forward wall, a rear wall, side walls, and a bottom wall;

a stationary jaw removably mounted at a mid-point on the main body;

a first movable slide and a second movable slide mounted in the recess for respectively guiding the first and second movable vise jaws, wherein the first movable vise jaw is removably mounted to the first movable slide and a second movable vise jaw is removably mounted to the second movable slide; and means for moving the first and second movable slides.

2. The machining vise according to claim 1, wherein the means for moving includes a hydraulic drive.

3. The machining vise according to claim 1, wherein the means for moving includes a screw drive shaft.

4. The machining vise according to claim 1, further including means for replacing a screw drive system with a hydraulic drive system.

5. The machining vise according to claim 1, further including a brake assembly attached to the second movable slide to control the movement of the first movable slide and the second movable slide.

6. The machining vise according to claim 1, further including an enclosure plate fully enclosing the recess to protect components held therein.

7. The machining vise according to claim 1, wherein the main body is made from aluminum.

8. A machining vise, comprising:

a main body having a recess;

a stationary jaw removably mounted at a mid-point on the main body;

a first movable slide and a second movable slide mounted in the recess, wherein a first jaw is removably mounted to the first movable slide and a second jaw is removably mounted to the second movable slide;

means for moving the first and second movable slides;

a brake assembly attached to the second movable slide to control the movement of the first movable slide and the second movable slide; and an offset assembly including an offset body integrally formed with the second movable slide to provide an initial offset movement of the second movable slide prior to the resistance of the brake assembly being overcome, and the offset assembly includes an offset bolt mounted for rotation within the offset body to establish a set offset.

9. The machining vise according to claim 8, wherein the offset assembly includes a return spring which causes the second movable slide to move the offset amount prior the resistance of the brake assembly being overcome.

10. The machining vise according to claim 8, wherein the offset bolt includes at least two offset options that may be selected.

11. A machining vise, comprising:

a main body having a recess;

a stationary jaw removably mounted at a mid-point on the main body;

a first movable slide and a second movable slide mounted in the recess, wherein a first jaw is removably mounted to the first movable slide and a second jaw is removably mounted to the second movable slide;

means for moving the first and second movable slides;

a brake assembly attached to the second movable slide to control the movement of the first movable slide and the second movable slide, the brake assembly including a brake body coupled to the second movable slide and a resilient biased brake pad extending between the brake body and the main body for controlling movement of the second movable slide.

12. The machining vise according to claim 11, wherein the brake is formed from brass.

13. The machining vise according to claim 11, wherein the brake body and the resilient biasing brake pad are integrally formed.

14. A machining vise, comprising:

a main body having a recess;

a stationary jaw removably mounted at a mid-point on the main body;

a first movable slide and a second movable slide mounted in the recess, wherein a first jaw is removably mounted to the first movable slide and a second jaw is removably mounted to the second movable slide; and a drive shaft coupled to the first and second movable slides for moving the first and second slides in a controlled manner, the drive shaft including a spline drive shaft mounted on the main body for rotation by the user and main screw shaft floatingly coupled to the spline drive shaft for rotation therewith, wherein a buffer is positioned between the spline drive shaft and the main body to permit some movement of the spline drive shaft as it is drawn with the movement of the main screw shaft.

15. The machining vise according to claim 14, wherein the buffer is a resilient o-ring.

16. The machining vise according to claim 14, wherein the buffer is positioned adjacent thrust bearing.

17. A machining vise, comprising:

a main body having a recess;

a first movable slide and a second movable slide mounted in the recess, wherein a first jaw is mounted to the first movable slide;

means for moving the first and second movable slides; and a single jaw conversion member adapted for selective attachment to the main body and the second movable slide such that the machining vise is converted to a single jaw machining vise permitting the machining of larger work pieces.

18. The machining vise according to claim 17, wherein the single jaw conversion member includes a recess for receiving a knuckle of the second movable slide.

19. A machining vise, comprising:

a main body for guiding at least one movable vise jaw;

a stationary jaw mounted on the main body;

at least a first movable slide mounted in the main body for moving the movable vise jaw;

a hydraulic drive for moving the first movable slide; and a first piston coupled to the first movable jaw and in fluid communication with the hydraulic drive; wherein hydraulic pressure supplied by the hydraulic drive causes the first movable slide to move the vise jaw between a clamped and an unclamped position.

20. The machining vise according to claim 19, further including a screw drive shaft working in combination with the hydraulic drive to move the first movable slide.

21. The machining vise according to claim 20, wherein the piston is coupled to the screw drive shaft to move the first movable slide.

22. The machining vise according to claim 19, further including a second movable slide, including a second jaw, mounted in the main body, wherein the hydraulic drive moves the second movable slide between a clamped and an unclamped position.

23. The machining vise according to claim 19, wherein the hydraulic drive is a single acting hydraulic system.

24. The machining vise according to claim 19, wherein the hydraulic drive is a double acting hydraulic system.

25. The machining vise according to claim 20, wherein the hydraulic drive includes means for permitting the use of the hydraulic drive to function as either a single acting hydraulic system or a double acting hydraulic system.

26. The machining vise according to claim 25, wherein the means for permitting is a spring return assembly coupled between the first piston and the first movable slide.

* * * * *